US008647085B2

(12) United States Patent
Iwano et al.

(10) Patent No.: US 8,647,085 B2
(45) Date of Patent: Feb. 11, 2014

(54) SCROLL FLUID MACHINE HAVING A COMMUNICATION PASSAGE BETWEEN AN INNER PERIPHERY OF LIP SEAL AND AN OUTER PERIPHERY OF DRIVE SHAFT OR RING

(75) Inventors: Kiminori Iwano, Sagamihara (JP); Susumu Sakamoto, Kawasaki (JP); Yoshio Kobayashi, Ebina (JP); Koichi Tashiro, Chigasaki (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 348 days.

(21) Appl. No.: 13/176,894

(22) Filed: Jul. 6, 2011

(65) Prior Publication Data

US 2012/0009077 A1 Jan. 12, 2012

(30) Foreign Application Priority Data

Jul. 7, 2010 (JP) ..... 2010-154416
Jun. 10, 2011 (JP) ..... 2011-129772

(51) Int. Cl.
*F03C 4/00* (2006.01)
*F04C 2/00* (2006.01)
*F04C 18/00* (2006.01)

(52) U.S. Cl.
USPC ..... 418/55.4; 418/55.6; 418/140; 418/144; 277/549; 277/562

(58) Field of Classification Search
USPC ..... 418/55.1–55.6, 57, 140, 144; 277/349, 277/353, 549, 552, 558, 561–562, 563, 572, 277/534, 530
See application file for complete search history.

(56) References Cited

U.S. PATENT DOCUMENTS

| | | | | |
|---|---|---|---|---|
| 2008/0206083 | A1* | 8/2008 | Suefuji et al. | 418/55.4 |
| 2009/0108537 | A1* | 4/2009 | Murakami et al. | 277/549 |
| 2009/0166984 | A1* | 7/2009 | Matsui et al. | 277/534 |
| 2010/0295253 | A1* | 11/2010 | Tadano et al. | 277/549 |

FOREIGN PATENT DOCUMENTS

| | | | | |
|---|---|---|---|---|
| JP | 62-96166 | U | 6/1987 | |
| JP | 8-254213 | A | 10/1996 | |
| JP | 10047266 | A * | 2/1998 | F04C 18/02 |
| JP | 2004092480 | A * | 3/2004 | F04C 18/02 |
| JP | 2004-340255 | A | 12/2004 | |

* cited by examiner

*Primary Examiner* — Theresa Trieu
(74) *Attorney, Agent, or Firm* — Crowell & Moring LLP

(57) ABSTRACT

A scroll fluid machine with ensured reliability of an oil seal and a bearing even in a compressor operation at high rpm and high load is provided, which includes: a fixed scroll; an orbiting scroll facing the fixed scroll and having a boss provided on a face opposite to the fixed scroll; a drive shaft having a leading end mounted to the boss; an orbiting bearing supporting the drive shaft in connection with the orbiting scroll; and a seal member placed between the boss and the drive shaft to seal against a lubricant supplied to the orbiting bearing. The seal member has an oil lip producing action of moving the lubricant toward the orbiting bearing by rotation of the drive shaft. A communication passage is provided in the oil lip for communication between a space between the orbiting bearing and the seal member and a space outside the boss.

17 Claims, 7 Drawing Sheets

SCROLL FLUID MACHINE HAVING A COMMUNICATION PASSAGE BETWEEN AN INNER PERIPHERY OF LIP SEAL AND AN OUTER PERIPHERY OF DRIVE SHAFT OR RING

This application claims the priority of Japanese Patent Application Nos. JP 2010-154416, filed Jul. 7, 2010, and JP 2011-129772, filed Jun. 10, 2011, the disclosures of which are expressly incorporated by reference herein in their entirety.

BACKGROUND OF THE INVENTION (i) Field of the Invention

The present invention relates to a scroll fluid machine and, more particularly, to a scroll fluid machine for lubricating an orbiting bearing with grease.

(ii) Description of the Related Art

JP-A No. 2004-340255 discloses a structure of an orbiting-bearing oil seal of a scroll compressor that includes an L-shaped cross-section and annular sealing member provided in the oil seal and having a breathing hole formed therein for a flow of outside air into the inside of the orbiting bearing housing.

JP-A No. H08-254213 discloses a water-pump bearing hermetic structure in which an oil seal having a plurality of seal lips (lip seals) is placed in a dividing area between water and a lubricant oil and a groove or projection is provided in the seal lip to prevent leakage of the water or lubricant.

JP-U No. S62-096166 discloses an oil seal that includes a lip having an annular sliding surface on which a plurality of first protrusions are inclined uniformly along the axis and a plurality of second protrusions inclined opposite to the inclined direction of the first protrusions along the axis in order to use the pumping action of the protrusions to discharge oil flowing on the sliding surface of the lip toward the bearing so that the dust flowing onto the sliding surface of the lip from the atmosphere is discharged back to the atmosphere.

JP-A No. 2004-340255 has a risk of leakage of the lubricant from the lip seal due to increased pressure in the orbiting bearing housing if the breathing hole is clogged with the lubricant.

In JP-A No. H08-254213, the hermetically enclosed space is defined by the seal lips of the oil seal provided on both sides of the sealing device of the bearing. This poses a risk of stepwise leakage of a lubricant from the seal lip if the internal pressure in the sealing device of the bearing is increased due to an increase in temperature of the bearing or the like during the operation of the water pump.

In JP-U No. S62-096166, because the first protrusions and the second protrusions are placed in contact with the shaft so as to be disconnected, a hermetically enclosed space is created in the orbiting bearing housing when the oil seal is used for orbiting bearing in a scroll compressor. JP-U No. S62-096166 has a risk of stepwise leakage of a lubricant from the lip if the internal pressure in the sealing device of the bearing is increased due to an increase in temperature of the bearing or the like.

SUMMARY OF THE INVENTION

The present invention has been made in view of the above circumstances and provides a scroll fluid machine designed to minimum a leakage of a lubricant even in operation of a compressor at high rpm and high load.

An aspect of the present invention provides a scroll fluid machine including: a fixed scroll; an orbiting scroll that is placed facing the fixed scroll and has a boss provided on a face opposite to a face facing the fixed scroll; a drive shaft that has a leading end mounted to the boss; an orbiting bearing that supports the drive shaft in connection with the orbiting scroll; and a seal member that is placed between the boss and the drive shaft to seal against a lubricant supplied to the orbiting bearing. The seal member has an oil lip producing action of moving the lubricant toward the orbiting bearing by rotation of the drive shaft. A communication passage is provided in the oil lip for communication between a space formed between the orbiting bearing and the seal member and a space formed outside the boss.

Another aspect of the present invention provides a scroll fluid machine including: a fixed scroll; an orbiting scroll that is placed facing the fixed scroll and performs orbiting motion; a drive shaft that is coupled to the orbiting scroll via a crank and rotates the orbiting scroll; an orbiting bearing that supports the drive shaft in connection with the orbiting scroll; and a seal member that is in sliding contact with an outer periphery of the drive shaft or a ring attached to the drive shaft and seals against a lubricant supplied to the orbiting bearing. The seal member has a lip seal on which a plurality of protrusions extends at an angle with respect to an axis direction of the drive shaft. The lip seal is provided in a portion making sliding contact with the drive shaft or the ring. A communication passage is provided in the lip seal for communication between a space formed between the orbiting bearing and the seal member and a space formed on an opposite side of the seal member from the orbiting bearing.

According to the embodiments of the present invention, a scroll fluid machine with a minimum leakage of a lubricant even in operation of a compressor at high rpm and high load is achieved.

BRIEF DESCRIPTION OF THE DRAWINGS

The present invention will become fully understood from the detailed description given hereinafter and the accompanying drawings, wherein.

DETAILED DESCRIPTION OF THE INVENTION

First Embodiment

A scroll compressor according to the first embodiment as an example of the scroll fluid machine according to the embodiments of the present invention will be described below with reference to FIG. 1 to FIG. 9.

Figure 1:
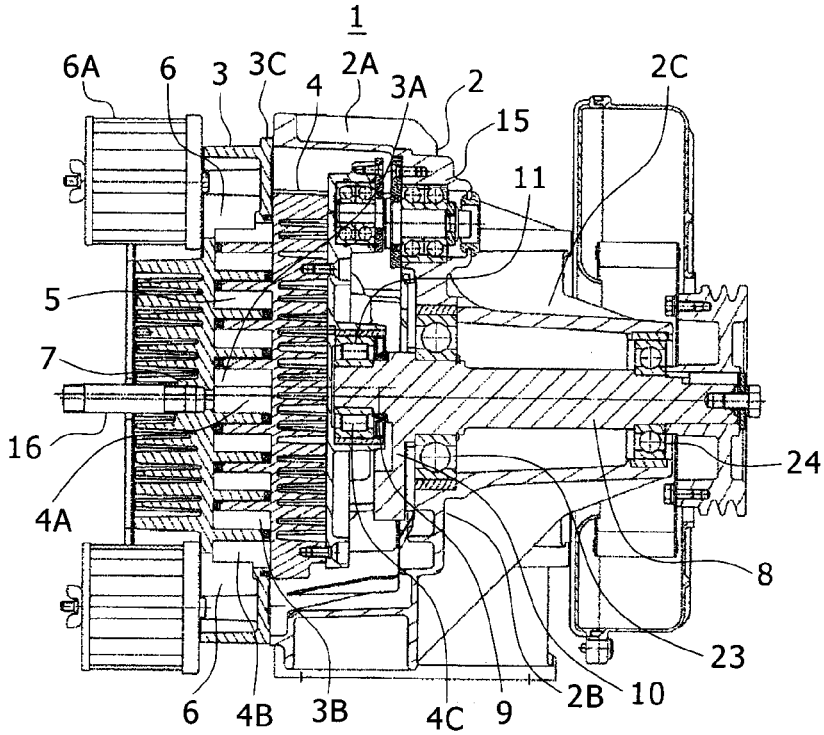
FIG. 1 is a cross-sectional view of a compressor according to a first embodiment of the present invention.
Figure 2:
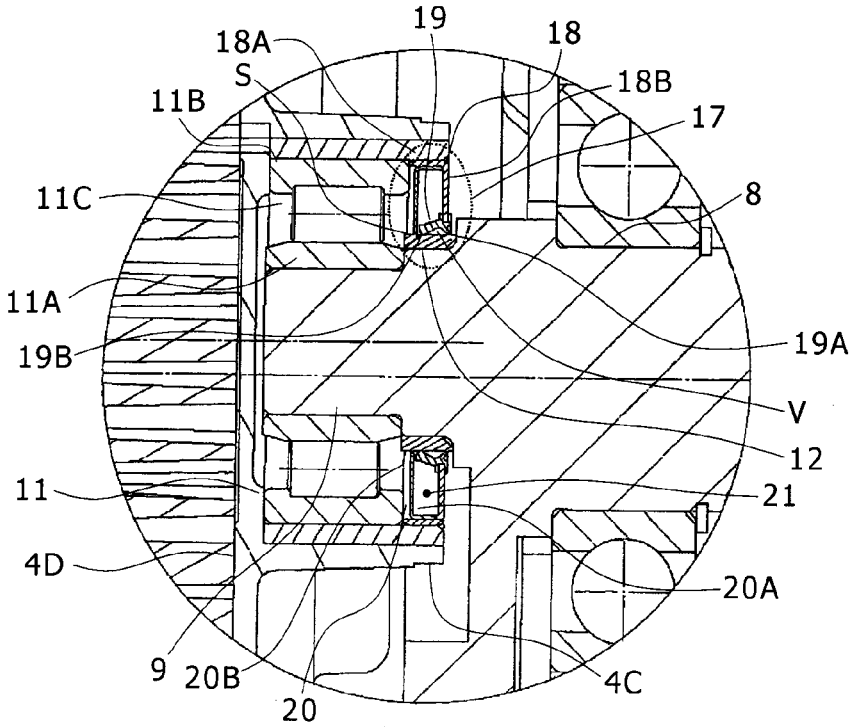
FIG. 2 is an enlarged view of a orbiting bearing according to the first embodiment of the present invention.

FIG. 1 is a cross-sectional view of a compressor according to the first embodiment. FIG. 2 is an enlarged view of part of the compressor around an orbiting bearing 11, which will be described later, in the first embodiment. FIGS. 1 and 2 show the compressor main-body 1 of a scroll air-compressor, which includes a casing 2 described below, a fixed scroll 3, an orbiting scroll 4, a drive shaft 8, a crank 9, an anti-rotation mechanism 15, and the like.

The casing 2 forms part of the outer shell of the compressor main-body 1, and is formed in a bottomed cylindrical shape having one closed end in the axis direction as shown in FIG. 1 and the other open end in the axis direction. Specifically, the casing 2 roughly include a cylinder 2A having the open end (closer to the fixed scroll 3 described later) in the axis direction, an annular bottom 2B formed integrally with the other end of the cylinder 2A in the axis direction and extending inward in the radial direction, and a cylinder-shaped bearing mount 2C extending from the inner peripheral edge of the annular bottom 2B in both axial directions.

The cylinder 2A of the casing 2 houses the orbiting scroll 4, described later, the crank 9 and the anti-rotation mechanism 15 and the like. A plurality of the anti-rotation mechanisms 15 (only one of them is shown in FIG. 1) are arranged between the bottom 2B of the casing 2 and an end plate 4A of the orbiting scroll 4 at predetermined intervals in the peripheral direction.

The fixed scroll 3 is illustrated as a scroll member stationarily placed on the open end of the casing 2 (the cylinder 2A). As illustrated in FIG. 1, the fixed scroll 3 roughly includes an end plate 3A formed in a disc shape, a spiral wrap 3B erected on the surface of the end plate 3A, and a cylindrical supporter 3C that is provided on the outer periphery of the end plate 3A so as to surround the outside of the wrap 3B in the radial direction and is secured to the open end of the casing 2 (the cylinder 2A) with a plurality of bolts (not shown).

The orbiting scroll 4, which forms another scroll member, is placed in the casing 2 to face the fixed scroll 3 in the axis direction and allowed to orbit in the casing 2. The orbiting scroll 4 roughly includes a disc-shaped end plate 4A, a spiral wrap 4B erected on the surface of the end plate 4A, and a cylindrical boss 4C that projects from the rear face of the end plate 4A (opposite to the wrap 4B) and is mounted on the crank 9 which is described later through the orbiting bearing 11, as illustrated in FIG. 1.

The anti-rotation mechanisms 15 described later are placed close to the outer periphery of the rear face of the orbiting scroll 4 (the end plate 4A) between the orbiting scroll 4 and the bottom 2B of the casing 2. The anti-rotation mechanisms 15 are arranged at predetermined intervals in the peripheral direction of the orbiting scroll 4. The center of the boss 4C of the orbiting scroll 4 deviates by a predetermined length (orbiting radius) in the radial direction from the center of the fixed scroll 3.

Reference numeral 5 in FIG. 1 denotes a plurality of compression chambers defined between the wrap 3B of the fixed scroll 3 and the wrap 4B of the orbiting scroll 4. Each of the compression chambers 5 is defined by the wraps 3B, 4B and the end plates 3A, 4A by placing the wrap 4B of the orbiting scroll 4 to overlap the wrap 3B of the fixed scroll 3 as illustrated in FIG. 1.

Reference numeral 6 denotes an inlet provided in the outer periphery of the fixed scroll 3, from which outside air is sucked through, for example, an inlet air filter 6A and/or the like. The sucked air is continuously compressed in the respective compression chambers 5 in step with the orbiting operation of the orbiting scroll 4.

Reference numeral 7 denotes an outlet provided at the center of the fixed scroll 3, through which the compressed air is discharged from the compression chamber 5 of the plurality of compression chambers 5 located close to the innermost periphery toward a later-described storage tank (not shown). That is, the orbiting scroll 4 is driven by an electric motor or the like (not shown) via the drive shaft 8 and the crank 9 which will be described later, thereby to perform the orbiting motion with respect to the fixed scroll 3 while being inhibited from rotating on its axis by the later-described anti-rotation mechanisms 15.

In this manner, air is sucked from the inlet 6 of the fixed scroll 3 into the compression chamber 5 of the plurality of compression chambers 5 located close to the outer periphery, and then is compressed continuously in each compression chamber 5. Then, the compression chamber 5 located close to the inner periphery discharges the compressed air outward from the outlet 7 located close to the center of the end plate 3A.

The drive shaft 8 is rotatably mounted to the bearing mount 2C of the casing 2 via bearings 23, 24. The base end of the drive shaft 8 (one end in the axis direction) located outside the casing 2 is detachably connected to a drive source such as an electric motor or the like (not shown), so that the drive shaft 8 is rotated by the electric motor. The boss 4C of the orbiting scroll 4 is orbitingly coupled to the leading end of the drive shaft 8 (the other end in the axis direction) via the crank 9 and the orbiting bearing 11.

The crank 9 is provided integrally with the leading end of the drive shaft 8, and coupled to the boss 4C of the orbiting scroll 4 through the orbiting bearing 11. The crank 9 is rotated in conjunction with the drive shaft 8. This rotation is converted into the orbiting operation of the orbiting scroll 4 through the orbiting bearing 11.

A plurality of the anti-rotation mechanisms 15 (one of them is shown in FIG. 1) are provided between the bottom 2B of the casing 2 and the rear face of the orbiting scroll 4. Each of the anti-rotation mechanisms 15 is formed of, for example, an auxiliary crank mechanism. The anti-rotation mechanism 15 prevents the orbiting scroll 4 from rotating about its axis and imposes a thrust load from orbiting scroll 4 on the bottom 2B of the casing 2. Instead of the auxiliary crank mechanism, for example, a ball coupling mechanism, Oldham's mechanism or the like may be used to form the anti-rotation mechanism 15.

Reference numeral 16 denotes outlet piping connected to the outlet 7 of the fixed scroll 3. The outlet piping 16 forms part of outlet passage making connection between the storage tank (not shown) and the outlet 7.

The drive shaft 8 is equipped with a balance weight 10 for stabilization of the orbiting operation of the orbiting scroll 4.

The balance weight 10 is rotated integrally with the drive shaft 8 in the operation of the compressor.

The orbiting bearing 11 is disposed between the boss 4C of the orbiting scroll 4 and the crank 9. The orbiting bearing 11 supports the boss 4C of the orbiting scroll 4 to allow it to orbit around the crank 9 in order to compensate for the orbiting operation of the orbiting scroll 4 at a predetermined orbit radius with respect to the axis of the drive shaft 8.

Reference numeral 17 denotes a seal member provided between the boss 4C on a rear plate 4D and the crank 9 of the drive shaft 8 for sealing a lubricant for the orbiting bearing 11. As illustrated in FIG. 2, the seal member 17 includes a metallic cored bar 18 and a lip seal 19 made of, an elastically deformable resin material such as rubber or the like, for example, nitrile rubber, acrylic rubber, silicone rubber, fluororubber or the like. The inner peripheral surface of the seal member 17 is in sliding contact with the outer peripheral surface of a ring 12 attached on the drive shaft 8. Note that, if the ring 12 is not provided, the inner peripheral surface of the seal member 17 will be in sliding contact with the outer peripheral surface of the drive shaft 8.

The cored bar 18 of the seal member 17 is made up of a tubular mount 18A fitted to the inner periphery of the boss 4C serving as a shaft supporter for attachment, and an annular element 18B protruding inward in the radial direction from one end of the tubular mount 18A in the axis direction. The lip seal 19 is provided integrally with the inner periphery of the annular element 18B by use of one-piece molding, baking or the like.

The other end of the tubular mount 18A in the axis direction is the open end, and a shield plate 20, described later, is engaged with the inner periphery of the open end by means of press-fitting or the like. The tubular mount 18A of the seal member 17 (the cored bar 18) with the shield plate 20 mounted on the inner periphery of the tubular mount 18A is inserted into the inner periphery of the boss 4C, and pressed toward the other end in the axis direction to a position where the mount 18A comes into contact with the outer race 11B of the orbiting bearing 11.

The lip seal 19 of the seal member 17 has two lips 19A, 19B (hereinafter referred to as a "dust lip 19A" and an "oil lip 19B") sliding on and making contact with the outer peripheral surface of the ring 12 for seal sliding (or the outer peripheral surface of the drive shaft 8). The dust lip 19A located on one end in the axis direction stops the entry of external dust including particles and the like into a sealed space 21 described later. The oil lip 19B located on the other end in the axis direction of the lip seal 19 slides on and makes contact with the outer peripheral surface of the ring 12 in a position close to the shield plate 20 described later so as to stop the leakage of the lubricant supplied to the orbiting bearing 11 from the later-described sealed space 21 to the outside.

The first embodiment describes the lip seal 19 of the seal member 17 placed on the inner periphery of the seal member, but the lip seal 19 may be provided on the outer periphery of the seal member 17, instead of the inner periphery of the seal member 17. In this case, the lip seal 19 makes sliding contact with the boss 4C.

The sealed space 21 is defined between the boss 4C and the ring 12 and crank 9 on the drive shaft 8 and between the orbiting bearing 11 and the seal member 17. The sealed space 21 is formed as an annular space located between one end of the orbiting bearing 11 in the axis direction and the seal member 17 to prevent the leakage of the lubricant from the inside of the orbiting bearing 11 to the outside of the seal member 17, in other words, to a space outside the boss 4C (a space on the opposite side of the seal member 17 from the orbiting bearing 11).

The shield plate 20 is a shield member provided in the sealed space 21 defined by the seal member 17. The shield plate 20 is formed in a dish-like annular shape, has an outer periphery 20A which is the outside area in the radial direction. The outer periphery 20A is engaged from the other end in the axis direction with the mount 18A of the seal member 17 (the cored bar 18) by means of press-fitting or the like.

An inner periphery 20B is located on an inner side in the radial direction of the shield plate 20 and is the inside area in the radial direction. The inner periphery 20B surrounds the entire perimeter of the outer peripheral surface of the ring 12 to create a minute gap S between the inner periphery 20B and the outer peripheral surface in the radial direction. The dimension of the minute gap S is, for example, in a range from about 0.05 mm to about 0.5 mm. The shield plate 20 partitions the sealed space 21 between the orbiting bearing 11 and the seal member 17 in order to reduce the leakage of the lubricant from the orbiting bearing 11 toward the seal member 17.

The outer periphery 20A of the shield plate 20 is secured to the mount 18A of the seal member 17, and the inner periphery 20B faces the ring 12 with the minute gap S in between. For this reason, even if the lubricant flows toward an area close to the outer race 11B of the orbiting bearing 11 as a consequence of centrifugal force developed by the rotation of the drive shaft 8, the lubricant in this event can be prevented from flowing from the mount 18A of the seal member 17 (the cored bar 18) to the outside by the outer periphery 20A of the shield plate 20.

In this event, since the outer periphery 20A is secured to the mount 18A of the seal member 17 and the inner periphery 20B faces the ring 12 engaged with the drive shaft 8 with the minute gap S in between in the radial direction, shield plate 20, together with the outer race 11B of the orbiting bearing 11 and the like, compensates for the orbiting operation of the orbiting scroll 4 without affecting the rotation of the drive shaft 8.

The lubricant such as grease or the like supplied to the inside of the orbiting bearing 11 is inhibited from leaking to the outside by use of the shield plate 20 and the like within the sealed space 21 defined by the seal member 17, so that a plurality of rollers 11C can be maintained in the lubricated condition between the inner race 11A and the outer race 11B.

In addition, since the lip seal 19 of the seal member 17 has the dust lip 19A and the oil lip 19B making sliding contact with the outer peripheral surface of the ring 12, the dust lip 19A prevents the entry of external dust and the like into the sealed space 21, and the oil lip 19B prevents the leakage of the lubricant from the orbiting bearing 11 to the outside of the sealed space 21.

Figure 3:
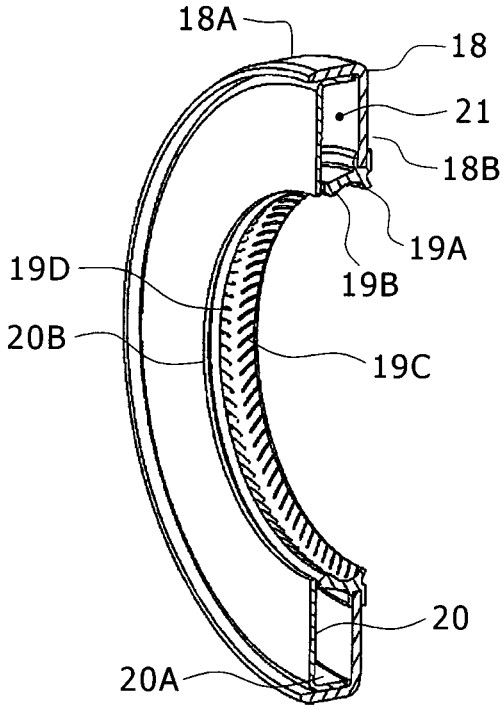
FIG. 3 is a perspective view of an oil seal according to the first embodiment of the present invention.

In the first embodiment, protrusions 19C, 19D are provided on the dust lip 19A and the oil lip 19B. As illustrated in FIG. 3, the protrusions 19C, 19D are formed in a linear shape extending in a direction at an angle with respect to the axis of the drive shaft 8, on the inner peripheral surfaces of the dust lip 19A and the oil lip 19B. A plurality of the protrusions 19C, 19D are spaced at intervals on the lip 19A, 19B. In this case, when the drive shaft 8 is rotated upon the operation of the scroll fluid machine and relative rotation of the ring 12 and the seal member 17 is produced, the lubricant may possibly flow from the orbiting bearing 11 toward the seal member. In the embodiment, the provision of the protrusions 19D leads to producing action (pumping action) to direct and move the lubricant, which has flown from the orbiting bearing 11 toward the seal member, back toward the orbiting bearing 11, resulting in the prevention of the lubricant leakage. Similarly, the pump action produced by the protrusions 19C upon the relative rotation of the ring 12 and the seal member 17 can direct (move) dust and the like intruding into a clearance between the seal member 17 and the ring 12 back to the outside. In this manner, the protrusions 19C act to produce the action (pumping action) to move dust in a direction opposite to the orbiting bearing 11, while the protrusions 19D act to produce the action (pumping action) to move the lubricant toward the orbiting bearing. In other words, the protrusions 19C and the protrusions 19D cause the pumping actions in the directions opposite to each other. For this reason, the two protrusions do not extend in parallel, and respectively extend at angles with respect to the axis of the drive shaft 8 in directions crossing each other. Note that the projections 19C, 19D are not required to be formed in an exactly straight line shape, may be formed in a curved shape as long as the pumping action is produced.

Further, the pumping actions produced by the protrusions 19C, 19D provided respectively on the dust lip 19A and the oil lip 19B are capable of improving respectively the sealing properties of the dust lip 19A and the oil lip 19B.

Figure 12:
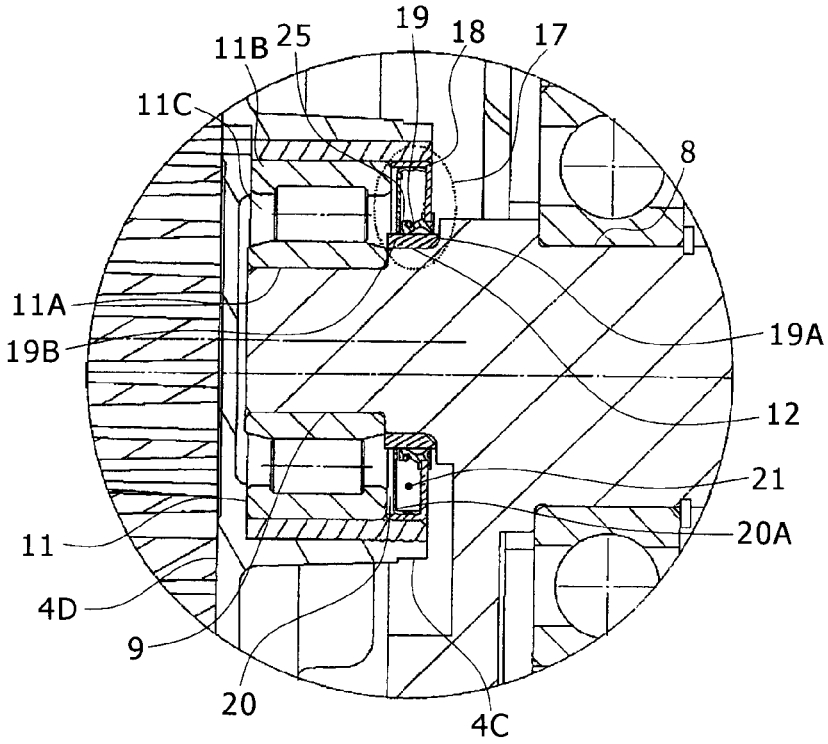
FIG. 12 is an enlarged view of an orbiting bearing in a related-art structure.

In particular, to achieve an improvement of the sealing properties, in most cases, the oil lip 19B is required to use a garter spring 25 and/or the like as illustrated in FIG. 12 to increase the tight-binding force of a contact portion of the oil lip 19B. However, an increase in the tight-binding force causes an increase in friction torque, resulting in power loss and also an increase in the amount of heat produced. Due to this, the reliabilities of the seal member as well as the orbiting bearing 11 and the lubricant are significantly reduced. According to the embodiment of the present invention, even without any means for improving the tight-binding force such as a garter spring, a sufficient degree of sealing property is ensured, thus improving the reliability of the orbiting bearing 11.

Figure 6:
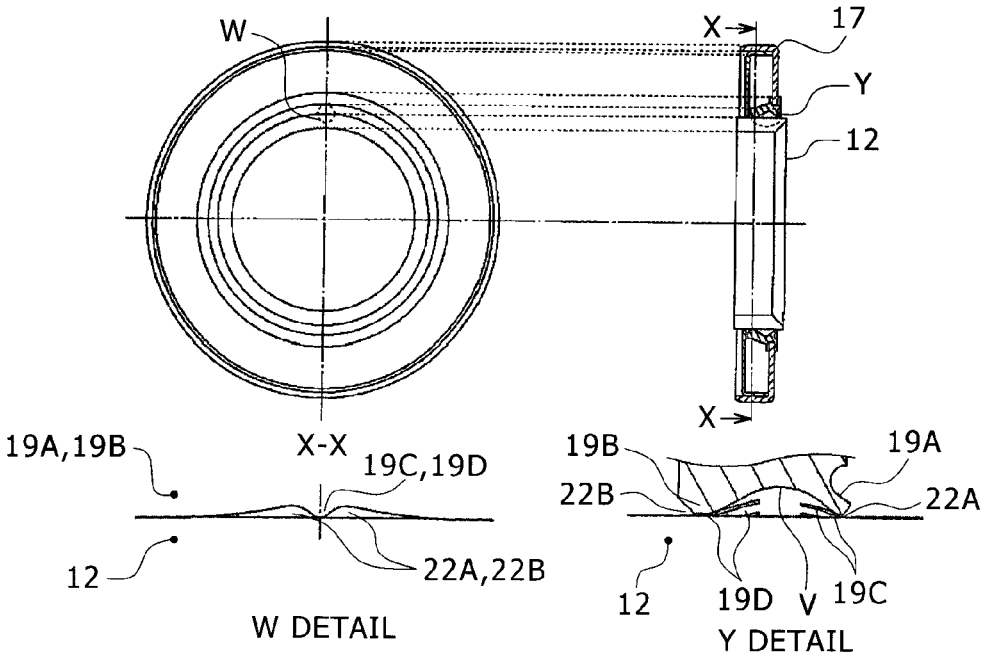
FIG. 6 is a diagram showing the contact between the oil seal and a ring according to the first embodiment of the present invention.

As illustrated in FIG. 6, a communication passage 22 (a dust-lip communication passage 22A, an oil-lip communication passage 22B) is provided in part of the sliding contact face of the inner periphery of the lip seal 19 making contact with the outer periphery of the drive shaft 8 (or the ring 12), for making a connection between the sealed space 21 which is a space formed between the orbiting bearing 11 and the seal member 17, and the space formed in the outside of the boss 4C (spacing formed on the opposite side of the seal member 17 from the orbiting bearing 11). Since the area between the dust lip 19A and the oil lip 19B of the seal member 17 is out of sliding contact with the outer periphery of the drive shaft 8 (or the ring 12) in the embodiment, a space V exists, which make a connection between the dust-lip communication passage 22A and the oil-lip communication passage 22B. As a result, even when the volume of the sealed space 21 is changed after the assembly process or when the temperature in the sealed space 21 is increased due to an influence of external heat and/or the like, the communication passage 22 can minimize the buildup of internal pressure, making it possible to maintain the interior of the sealed space 21 at atmospheric pressure. Because the protrusions 19C, 19D are provided, the communication passage 22 is formed in a space between the two sets of protrusions 19C and 19D.

On the other hand, JP-A No. H08-254213 does not disclose a communication passage formed in the seal lip (lip seal), the thread groove of the drive shaft or the rib. In JP-U No. S62-096166, the sliding contact area between the first protrusion and the second protrusion is not connected. If communication passages are provided between the plural first protrusions and between the plural second protrusions, the space between the bearing and the seal member will be hermetically sealed. In consequence, in the cases of using the seal member according to JP-A No. H08-254213 and JP-U No. S62-096166, the buildup of pressure in a space between the seal member and the bearing results.

Figure 4:
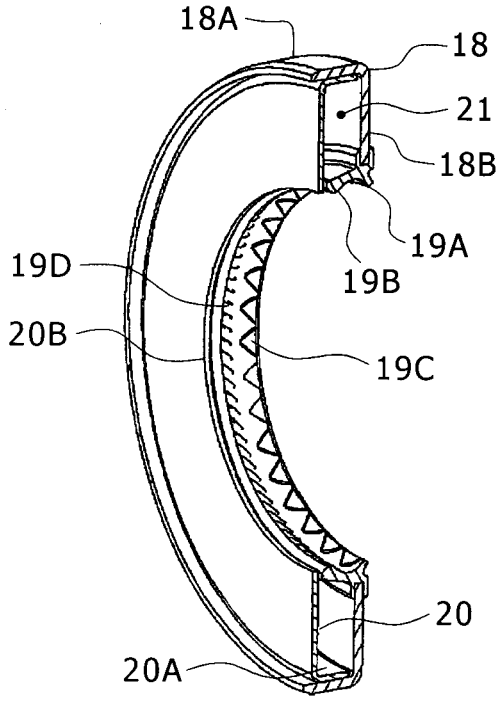
FIG. 4 is a perspective view of another oil seal according to the first embodiment of the present invention.
Figure 5:
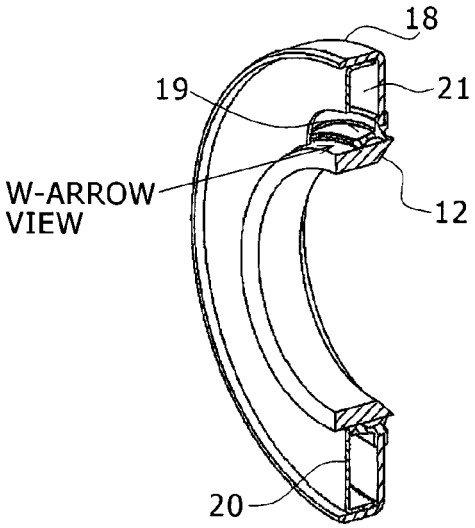
FIG. 5 is a perspective view of an oil seal according to the first embodiment of the present invention.

FIG. 5 is a perspective view illustrating the contact area between the ring 12 and the oil lip 19. The ring 12 and the dust lip 19A make contact with each other and slide as illustrated in the detail W in FIG. 6. The dust-lip communication passage 22A is formed on each side of the protrusion 19C along the protrusion 19C to make connection with the space V defined by the dust lip 19A and the oil lip 19B and outside air. The protrusion 19C provided on the inner side of the dust lip 19A may be formed in a combination of so-called inverted V shapes as illustrated in FIG. 4 such that the pumping action is produced on both sides in the direction that removes dust and the like outward from the space V in FIG. 2 and in the direction that returns air so as to prevent negative pressure from being produced in the space V.

The ring 12 and the oil lip 19B make contact with each other and slide as illustrated in FIG. 6. The oil-lip communication passage 22B is formed on each side of the protrusion 19D along the protrusion 19D to make connection with the space V defined by the dust lip 19A and the oil lip 19B and the sealed space 21. The protrusion 19C provided on the inner side of the dust lip 19A extends in a direction that removes dust and the like outward from the space V in order to prevent the entry of the dust and the like into the boss 4C.

Figure 7:
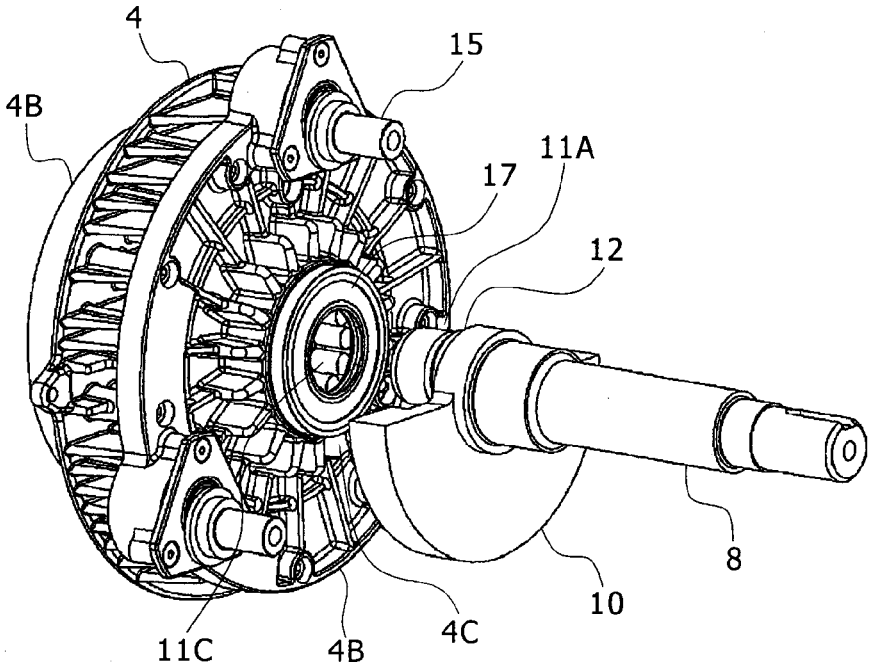
FIG. 7 is a perspective view illustrating a process of mounting the oil seal according to the first embodiment of the present invention.
Figure 8:
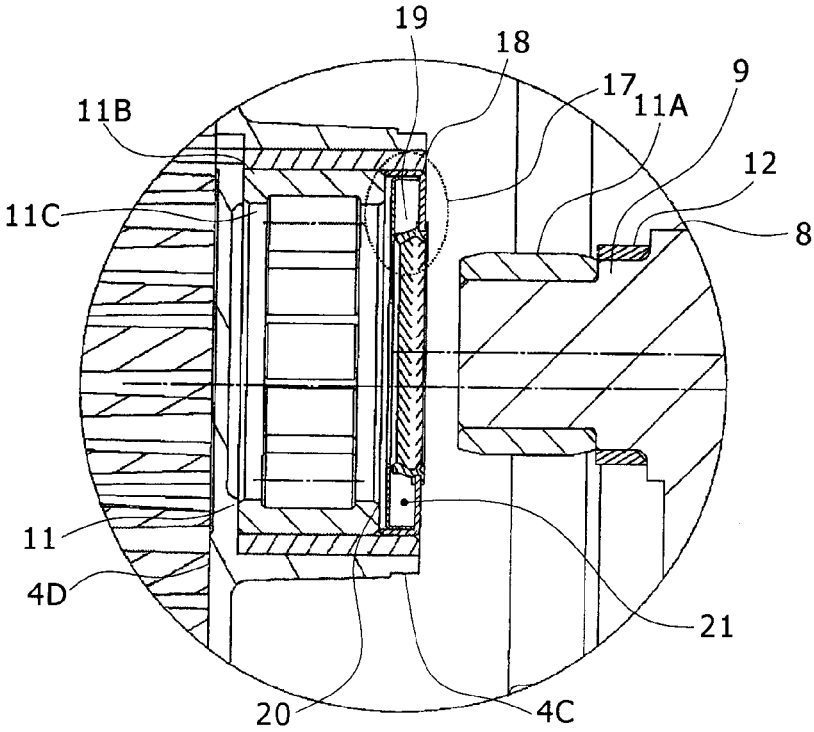
FIG. 8 is a cross-sectional view illustrating a process of mounting the oil seal according to the first embodiment of the present invention.
Figure 9:
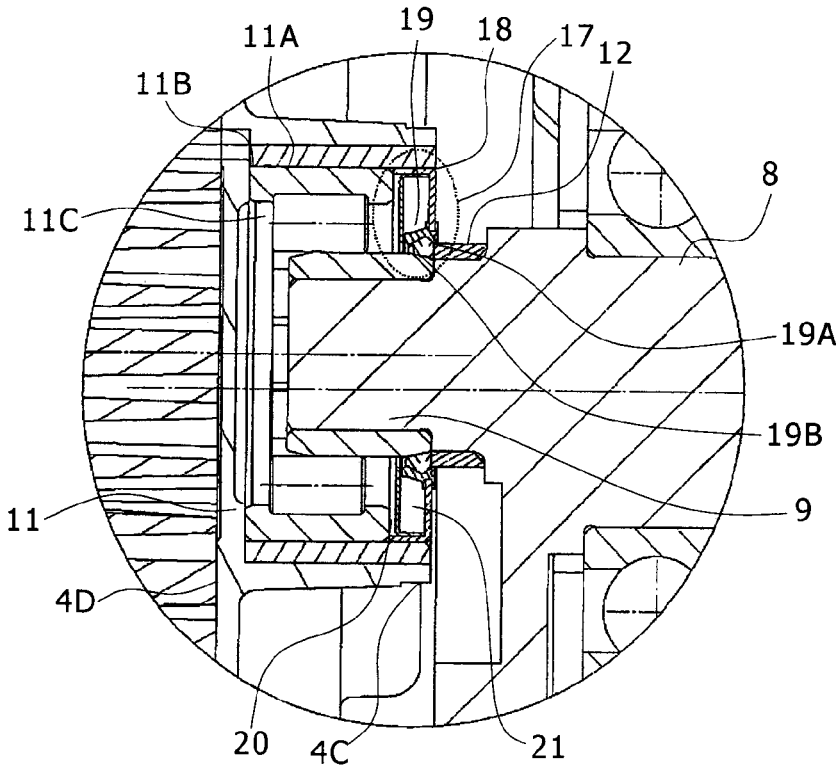
FIG. 9 is a cross-sectional view illustrating a process of mounting the oil seal according to the first embodiment of the present invention.

FIGS. 7 to 9 illustrate an assembling process of the orbiting scroll 4 and the drive shaft 8. FIG. 7 is a perspective view from which the bearings 24, 25, the casing 2 and the like which are pre-mounted on the drive shat 8 are omitted. From the state in FIG. 8 through the state in FIG. 9 to the state in FIG. 2, the crank 9 over which the orbiting-bearing inner race 11A and the ring 12 are previously fitted to the crank 9 is gradually inserted into the boss 4C in which are mounted the orbiting-bearing outer race 11B fitted into the boss 4C, the orbiting-bearing rollers 11C held rotatably in a retainer (not shown) inserted rotatably into the orbiting-bearing outer race 11B, and the seal member 17 fitted into the boss 4C.

When either the dust lip 19A or the oil lip 19B of the lip seal 19 of the seal member 17 comes into contact with the ring 12 after the state in FIG. 9 in the inserting process, the sealed space 21 is created in the boss 4C by the gap space of the orbiting bearing 11 and the seal member 17 and the seal line by the dust lip 19. Also, when the crank 9 is inserted to a predetermined position shown in FIG. 2, the volume of the sealed space 21 is changed to increase the pressure in the sealed space 21, thus producing an air damper effect. Accordingly, the crank 9 is required to be inserted to a predetermined position under the condition of the increased inner pressure in the sealed space 21, making the assembling process difficult.

Further, in the compression operation, high temperature heat is conducted through the boss 4C of the rear plate 4D and the like to the interior of the sealed space 21 between the orbiting bearing 11 and the seal member 17, so that the interior of the sealed space 21 is exposed to high temperatures. As a result, the inner pressure in the sealed space 21 is increased by thermal expansion and the lubricant in the orbiting bearing 11 is reduced in viscosity to change to a liquid form, posing a risk for slow leakage of the lubricant in liquid form from the seal member 17 to the outside.

Hence, the embodiment employs the structure of the communication passage 22 including the dust-lip communication passage 22A formed on each side of the protrusion 19C disposed on the dust lip 19A, the oil-lip passage 22B formed on both sides of the protrusion 19D disposed on the oil lip 19B, and the space V defined by the dust lip 19A and the oil lip 19B.

In consequence, even when the volume of the sealed space 21 is changed in the assembling process or the temperature in the sealed space 21 is increased by heat influences from the outside and/or the like, the buildup of the inner pressure is minimized because of the communication passage 22, thus maintaining the interior of the sealed space 21 at atmospheric pressure at all times. In this manner, the ensured assembling properties and the ensured productivity are achieved and the prevention of lubricant leakage is implemented to ensure the reliability of the bearing.

In addition, a lubricant refill mechanism and/or the like is provided in the boss 4C, the rear plate 4D or the like. Accordingly, when the lubricant is re-charged for the orbiting bearing 11 from the outside, even if the lubricant enters the sealed space 21 to change the volume of the sealed space 21, the interior of the sealed space 21 can be maintained at atmospheric pressure at all times, so that a smooth lubricant refill is achieved.

Second Embodiment

Figure 10:
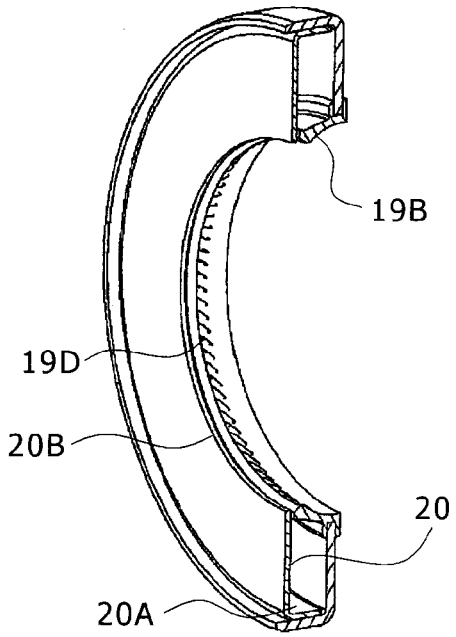
FIG. 10 is a perspective view of an oil seal (single lip) according to a second embodiment of the present invention.

Next, the second embodiment according to the present invention will be described with reference to FIG. 10. The same or similar components in the second embodiment as or to those in the first embodiment are designated by the same reference signs and the description is omitted. The second embodiment illustrates the structure of the seal member 17 of a shape without the dust lip 19A as compared with the case of the first embodiment, when an area around the boss 4C is clean. The lip seal 19 molded integrally with the cored bar 18 of the seal member 17 includes only the oil lip 19B. The protrusions 19D are provided on the oil lip 19B. The sealed space 21 is connected to outside air through the oil-lip communication passage 22B. As a result, the interior of the sealed space 21 can be mainlined at atmospheric pressure at all times and also the sealing properties can be implemented because the pumping action is caused by the protrusions 19D.

Third Embodiment

Figure 11:
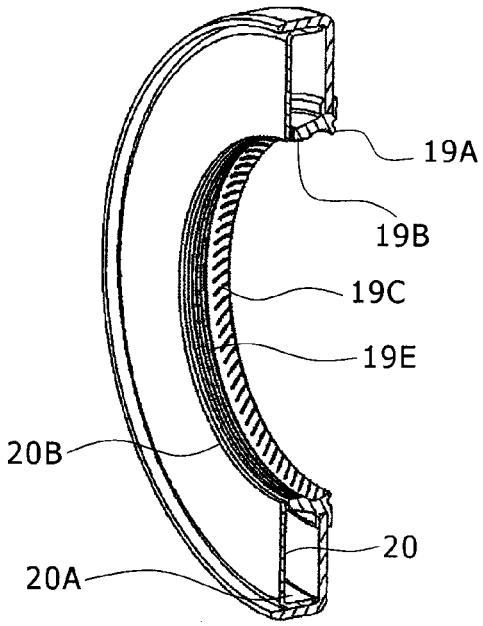
FIG. 11 is a perspective view of an oil seal (helical protrusion) according to a third embodiment of the present invention.

Next, the third embodiment according to the present invention will be described with reference to FIG. 11. The same or similar components in the third embodiment as or to those in the first embodiment or the second embodiment are designated by the same reference signs and the description is omitted. The third embodiment illustrates a helical-shaped protrusion 19E provided on the oil lip 19B. A helical-shaped communication passage 22B is formed along and on each side of the protrusion 19E in order to maintain the interior of the sealed space 21 at atmospheric pressure. A plurality of seal lines are formed in the axis direction by the helical-shaped protrusion 19E, and improved sealing properties can be achieved by the pumping action.

Fourth Embodiment

Figure 13:
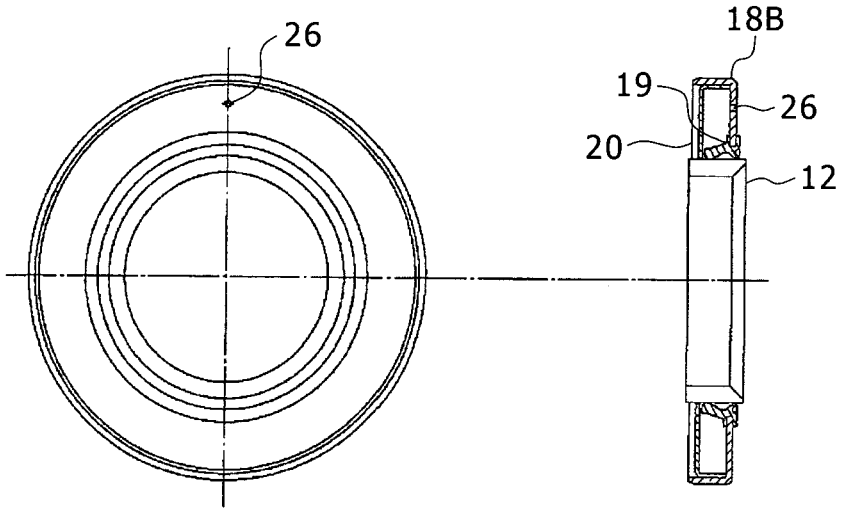
FIG. 13 is a front view and a cross-sectional view of an oil seal (breathing hole) according to a fourth embodiment of the present invention.

Next, the fourth embodiment according to the present invention will be described with reference to FIG. 13. The same or similar components in the fourth embodiment as or to those in the first to third embodiments are designated by the same reference signs and the description is omitted. The fourth embodiment illustrates at least one breathing hole 26 formed in the annular element 18B of the cored bar 18 of the seal member 17. The breathing hole 26 penetrates the seal member 17 toward the drive shaft 8 to make a connection between the space formed on one side of the seal member 17 facing the orbiting bearing 11 and the space formed on the other side. The breathing hole 26 makes it possible to more effectively reduce the buildup of the inner pressure than that in the case of providing the outside-air communication passage 22 alone and maintain the interior of the sealed space 21 at atmospheric pressure, even if the volume of the sealed space 21 is changed in the assembling process or if the communication passage 22 is partially clogged with the lubricant and therefore the temperature in the sealed space 21 is increased by the influence of external heat and/or the like. In consequence, the lubricant leakage can be prevented to provide the ensured reliability of the bearing.

When the breathing hole 26 is clogged with the lubricant accumulated in the space defined by the shield plate 20 and the cored bar 18, the outside-air communication passages 22 respectively formed in the lip seal 19 can be used to produce a communication effect.

The first to fourth embodiments have described the protrusions of the lip seal 19, but a groove instead of the protrusion may be formed.

The first to fourth embodiments have described the scroll fluid machine, but the present invention can be applied to a system including the scroll fluid machine as an element. For example, the present invention may be applied to a nitrogen-gas generator including the scroll fluid machine. The scroll fluid machine is not limited to the scroll compressor, and may be, for example, a scroll vacuum pump.

The first to third embodiments are not limited to the scroll fluid machine and may be applied to another type of compressor such as, for example, a reciprocating compressor or the like as long as it includes the drive shaft performing rotary motion, the bearing supporting the drive shaft and the seal member for sealing against the lubricant supplied to the bearing. In this case, the lip is also provided on the seal member for sealing against the lubricant lubricating the bearing and the communication passage is provided in the lip to prevent lubricant leakage.

On the other hand, since the scroll compressor is likely to produce the air-damper effect when the drive shaft is mounted in the boss in the assembling process, the applications of the first to fourth embodiments produce the effect of facilitating the assembling which can not be produced in another type of compressor.

The embodiments described above are merely for illustrative purpose only and are not meant to be limiting as to the technical scope of the invention. Various modifications and applications may occur without departing from the technical idea or the essential features of the present invention. An embodiment according to the present invention may be carried by a combination of the first to third embodiments.

It should be understood by those skilled in the art that various modifications, combinations, sub-combinations and alterations may occur depending on design requirements and other factors insofar as they are within the scope of the appended claims or the equivalents thereof.

What is claimed is:

1. A scroll fluid machine, comprising:

a fixed scroll;

an orbiting scroll that is placed facing the fixed scroll and has a boss provided on a face opposite to a face facing the fixed scroll;

a drive shaft that has a leading end mounted to the boss;

an orbiting bearing that supports the drive shaft in connection with the orbiting scroll; and a seal member that is placed between the boss and the drive shaft to seal against a lubricant supplied to the orbiting bearing, wherein: the seal member has an oil lip producing action of moving the lubricant toward the orbiting bearing by rotation of the drive shaft; and a communication passage is provided in the oil lip for communication between a space formed between the orbiting bearing and the seal member and a space formed outside the boss.

2. The scroll fluid machine according to claim 1, wherein a plurality of protrusions or grooves are provided on the oil lip to produce action of moving the lubricant toward the orbiting bearing by rotation of the drive shaft.

3. The scroll fluid machine according to claim 2, wherein the communication passage is provided between the plurality of protrusions or in the plurality of grooves.

4. The scroll fluid machine according to claim 2, wherein each of the plurality of protrusions or each of the plurality of grooves is formed in a straight line shape extending at an angle with respect to an axis direction of the drive shaft on an inner periphery of the oil lip.

5. The scroll fluid machine according to claim 2, wherein the protrusion or the groove is formed in a helical shape on the oil lip.

6. The scroll fluid machine according to claim 1, wherein the seal member is provided with a dust lip that prevents entry of dust into a sealed space.

7. The scroll fluid machine according to claim 6, wherein a plurality of protrusions or grooves are provided on the dust lip to produce action of moving the dust toward a side opposite to the orbiting bearing by rotation of the drive shaft.

8. The scroll fluid machine according to claim 7, wherein a plurality of protrusions or grooves having action of moving the dust toward the orbiting bearing by rotation of the drive shaft are provided on the dust lip.

9. The scroll fluid machine according to claim 1, wherein a shield plate is provided between the seal member and the orbiting bearing.

10. The scroll fluid machine according to claim 9, wherein an outer periphery of the shield plate is secured to a mount of the seal member and a space is formed between an inner periphery of the shield plate and the drive shaft.

11. A scroll fluid machine, comprising:

a fixed scroll;

an orbiting scroll that is placed facing the fixed scroll and performs orbiting motion;

a drive shaft that is coupled to the orbiting scroll via a crank and rotates the orbiting scroll;

an orbiting bearing that supports the drive shaft in connection with the orbiting scroll; and a seal member that is in sliding contact with an outer periphery of the drive shaft or a ring attached to the drive shaft and seals against a lubricant supplied to the orbiting bearing, wherein: the seal member has a lip seal on which a plurality of protrusions extends at an angle with respect to an axis direction of the drive shaft, provided in a portion making sliding contact with the drive shaft or the ring; and a communication passage is provided in the lip seal for communication between a space formed between the orbiting bearing and the seal member and a space formed on an opposite side of the seal member from the orbiting bearing.

12. The scroll fluid machine according to claim 11, wherein the communication passage is provided between the plurality of protrusions.

13. The scroll fluid machine according to claim 11, wherein the lip seal includes an oil lip for preventing the lubricant from leaking to the outside and a dust lip for preventing dust from entering the sealed space.

14. The scroll fluid machine according to claim 13, wherein the oil lip is provided with a plurality of protrusions producing action of moving the lubricant toward the orbiting bearing by rotation of the drive shaft.

15. The scroll fluid machine according to claim 14, wherein the dust lip is provided with a plurality of protrusions producing action of moving the dust toward a side opposite to the orbiting bearing by rotation of the drive shaft.

16. The scroll fluid machine according to claim 15, wherein the dust lip is provided with a plurality of protrusions producing action of moving the dust toward the orbiting bearing by rotation of the drive shaft.

17. The scroll fluid machine according to claim 11, wherein a breathing hole penetrates the seal member toward the drive shaft and makes communication between a space formed between the orbiting bearing and the seal member and a space formed on an opposite side of the seal member from the orbiting bearing.

* * * * *